United States Patent [19]

Bauvin

[11] 3,976,202

[45] Aug. 24, 1976

[54] BALANCED LIFTING BEAM

[76] Inventor: Rene Bauvin, Av. Rui Barbosa, 310-Apto. 17, Rio de Janeiro, Brazil

[22] Filed: May 7, 1975

[21] Appl. No.: 575,373

[30] Foreign Application Priority Data

Oct. 22, 1974 Brazil ..... 8788

[52] U.S. Cl. ..... 212/27; 212/14; 254/183

[51] Int. Cl.[2] ..... B66C 17/00

[58] Field of Search ..... 212/10, 11, 13, 14, 212/18, 19, 20, 21, 23, 24, 25, 27, 97, 98; 254/175.5, 183

[56] References Cited

UNITED STATES PATENTS 563,259 7/1896 Connet ..... 212/20

3,142,387 7/1964 Minty ..... 212/24

*Primary Examiner*—Robert J. Spar
*Assistant Examiner*—Lawrence J. Oresky
*Attorney, Agent, or Firm*—Emory L. Groff, Jr.

[57] ABSTRACT

A single beam traveling crane includes a trolley movable over the beam and a hoist block arrangement located on opposite sides of the trolley frame. The winch which controls the hoist block cable is mounted at one end of the beam rather than on the trolley itself which in combination with the split or divided arrangement of the hoist block on the trolley eliminates any torsional effort on the beam which permits a lighter beam structure.

2 Claims, 2 Drawing Figures

BALANCED LIFTING BEAM

Heavy overhead traveling cranes and gantry cranes are usually made of two parallel beams, both ends of which are mounted on a carriage traveling on rails. A trolley runs over the beam carrying a winch block, the load hook hanging between the two beams.

Such an arrangement has the following inconveniences: high cost and weight, loss of important space over the beams, deadweight on the center of the beam, inertia with unavoidable influence over the structure and the requirement of a power supply to move the trolley. In order to overcome such inconvenience, single beam overhead traveling cranes and gantry cranes have been manufactured with a hoist hanging under the beam, thus losing space under the beam without solving other inconveniences.

Overhead traveling cranes and gantry cranes of the single beam type provided with a lateral hoist and winches have been also manufactured, solving the loss of vertical space without solving other inconveniences and adding the effect of undesirable torsion on the beam which can be corrected only with an increase in weight and resulting increase in the cost of the beam.

The primary object of the present invention is to overcome the aforementioned disadvantage by providing a balanced lifting beam wherein the winch is fixed on one end of the beam, the trolley only traveling over the beam with the hoist block being divided on each side of the trolley and moved by the cable of the winch. This eliminates any torsional effect on the beam, thus allowing a lighter beam structure and the most simple type of construction possible.

The other end of the winch cable can be fixed to the beam or to the drum of a second winch in order to increase the lifting speed without employing a clutch or any mechanical control devices.

The balanced lifting beam according to the present invention solves all the inconveniences previously referred to which are found in overhead traveling cranes and gantry cranes by providing reduced cost and weight, reduced loss of space and reduced dead weight on the center of the beam. The inertia of the traveling trolley is almost nil and no power supply is required to keep the trolley in movement over the beam.

In the drawings, wherein similar reference numerals are used to designate similar parts:

Figure 1:
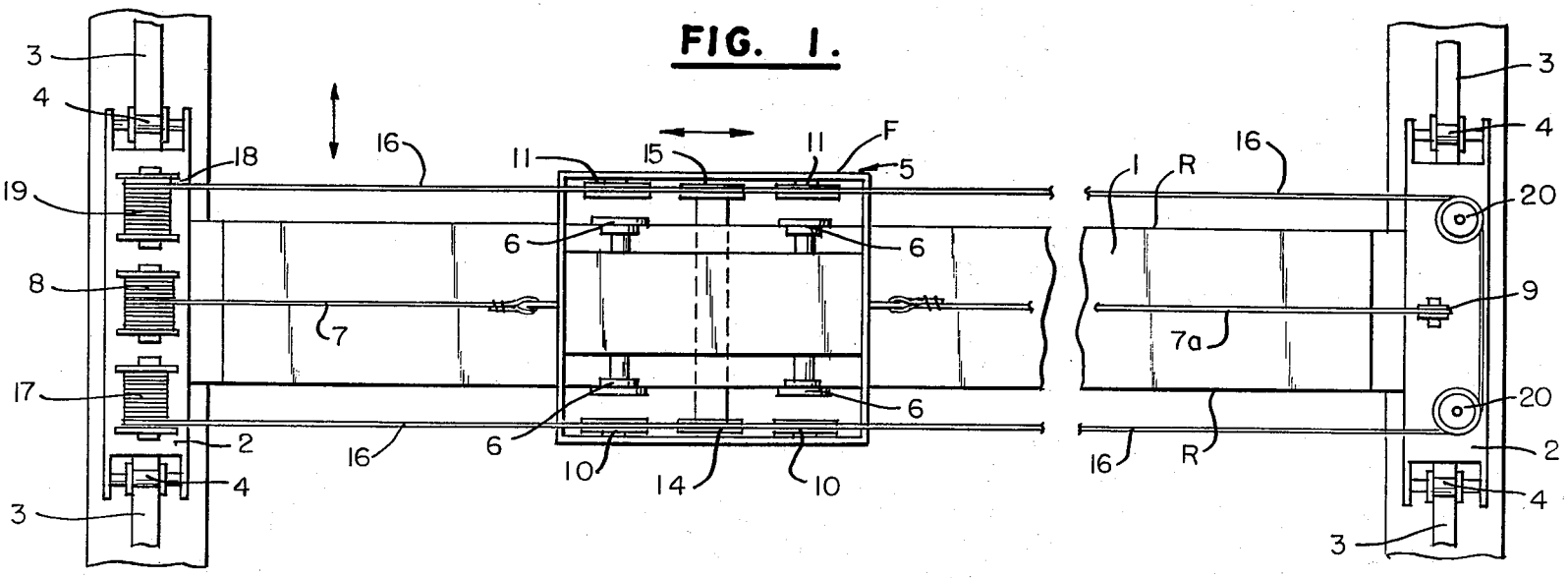
FIG. 1 is a top plan view of a lifting beam embodying my invention.
Figure 2:
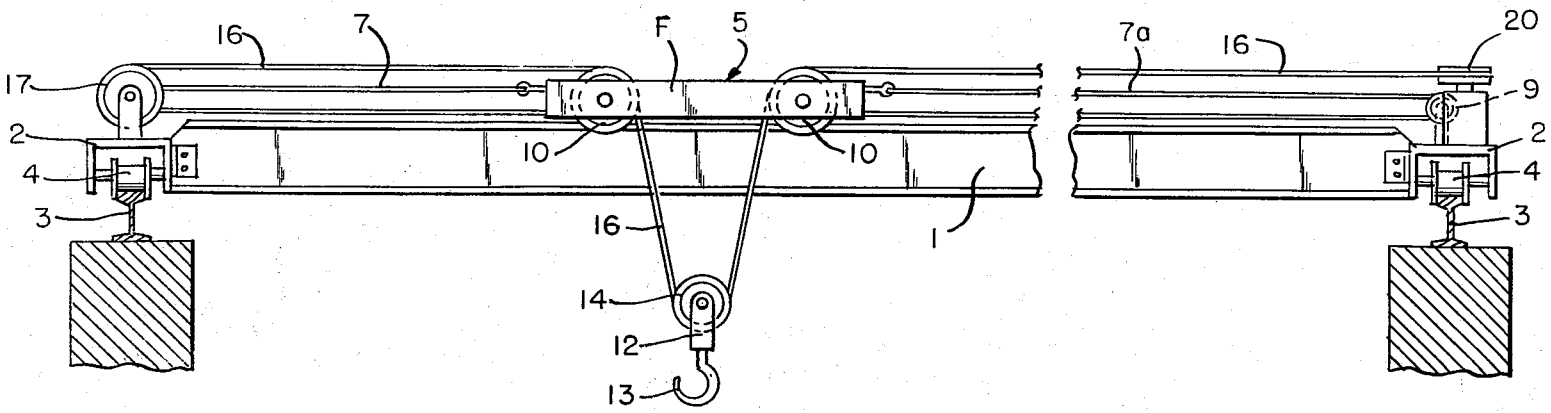
FIG. 2 is an end elevation of the lifting beam shown in FIG. 1.

Referring to the drawings in detail, FIGS. 1 and 2 show a preferred embodiment of a balanced beam for overhead traveling cranes with a simple hoist block in accordance with my invention. The cables shown can be doubled, tripled, etc., in order to increase the mechanical advantage and to increase the lifting capacity without increasing the traction cable for the trolley.

A beam 1 is mounted on two carriages 2,2 movably mounted on spaced apart parallel rails 3,3 by means of pairs of wheels 4,4 fixed to the carriages. A trolley 5, including a frame F, is provided with four wheels 6, mounted on said frame. The trolley is mounted for transverse travel on rails R of beam 1 and its movement can be controlled by a motor (not shown) which drives the wheels 6 or by an endless cable 7, one end of which is secured to a drum 8 mounted on the carriage at one end of the beam, the other end of the cable being attached to said trolley. A second cable 7a has one of its ends attached to said drum and passes over a pulley 9 mounted on the opposite carriage, then has the other of its ends attached to the trolley.

The hoist block comprises two pairs of pulleys 10,10,11,11, one pair mounted on each side of the trolley 5 and a transverse beam 12 which supports hook 13, pulleys 14 and 15 and the cable 16.

Cable 16 is moved by drum 17 mounted on one of the carriages 2 and passes around one half of the hoist block pulleys 10,10 and 14. After passing around said pulleys, the cable passes over a pair of return pulleys 20,20 mounted on the other of the carriages 2 and comes back and around the other half of the hoist block pulleys 11,11 and 15 and is tied up at a fixed point 18 on the carriage, or at a second drum 19 mounted on one of the carriages 2 when an increase in speed is required.

The number of pulleys 10–11 and 14–15 of the hoist block can be increased, but are always divided into two symmetrical halves, in order to increase the lifting capacity on the hook without increasing the strain on the cable.

Motive power means (not shown) which is controllable from a remote point is utilized to drive the drums 8 and 17.

I claim:

1. In an overhead crane installation including spaced apart parallel rails mounted on a supporting structure, a single traveling beam spanning the space between said rails, said beam including spaced apart parallel rails, a carriage at each end of said beam, wheels mounted on said carriage and riding on said installation rails, a trolley mounted on said beam, said trolley including a frame, a pair of wheels mounted on each side of said frame and movable over the rails of said beam, a first rotatable drum mounted at one end of said traveling beam, a first cable having one of its ends secured to said first drum and the other end secured to said trolley, a pulley mounted at the opposite end of said beam, a second cable having one of its ends secured to said first drum, said cable returning around said pulley at the opposite end of said beam and having the other of its ends secured to the opposite end of said trolley, a hoist block mounted on said trolley frame, said hoist block comprising a pair of pulleys mounted on each side of said trolley frame, a transverse hoist beam including a pulley mounted at each end thereof and a hook suspended therefrom, a second drum mounted on one of said carriages at one end of said traveling beam, a pair of return pulleys mounted on the other of said carriages at the opposite end of said traveling beam, a third cable having one end fixed to said drum and passing over one pair of said hoist pulleys, then passing over one of said transverse hoist beam pulleys around each of said return pulleys and over the other pair of hoist pulleys and the other of said transverse hoist beam pulleys and connected at its opposite end to a fixed point on said carriage on which the second drum is mounted, and power means for rotating one of said drums to raise and lower said hook as required.

2. An overhead crane installation according to claim 1 wherein a pair of drums are mounted on one of said carriages and said third cable has one of its ends connected to one drum and the other of its ends connected to the other drum.

* * * * *